US011129449B2

(12) United States Patent
Wang et al.

(10) Patent No.: US 11,129,449 B2
(45) Date of Patent: Sep. 28, 2021

(54) DOUBLE-SIDED USABLE BELT BUCKLE

(71) Applicant: QING CAN XING HARDWARE CRAFTS CO., LTD., Quanzhou (CN)

(72) Inventors: Nianqing Wang, Quanzhou (CN); Jindang Wang, Quanzhou (CN)

(73) Assignee: QING CAN XING HARDWARE CRAFTS CO., LTD., Quanzhou (CN)

( * ) Notice: Subject to any disclaimer, the term of this patent is extended or adjusted under 35 U.S.C. 154(b) by 0 days.

(21) Appl. No.: 16/867,533

(22) Filed: May 5, 2020

(65) Prior Publication Data

US 2020/0352285 A1 Nov. 12, 2020

(30) Foreign Application Priority Data

May 7, 2019 (CN) ..... 201920647320.4

(51) Int. Cl.
*A44B 11/24* (2006.01)
*A41F 9/00* (2006.01)

(52) U.S. Cl.
CPC ..... *A44B 11/24* (2013.01); *A41F 9/002* (2013.01)

(58) Field of Classification Search
CPC ..... A41F 9/002; A44B 11/006; A44B 11/24
See application file for complete search history.

(56) References Cited

U.S. PATENT DOCUMENTS 4,406,043 A * 9/1983 Friedman ..... A44B 11/006 24/171
4,458,390 A * 7/1984 Fogelson ..... A44B 11/006 24/182
7,480,967 B2 * 1/2009 Kojoori ..... A44B 11/006 2/322
9,930,936 B2 * 4/2018 Liu ..... A44B 11/006
2010/0205789 A1 * 8/2010 Labelson ..... A44B 11/006 24/458
2014/0215766 A1 * 8/2014 Liu ..... A44B 11/006 24/188
2014/0259545 A1 * 9/2014 King ..... A41F 9/002 24/170

* cited by examiner

*Primary Examiner* — David M Upchurch

(57) ABSTRACT

The present disclosure provides a double-sided usable belt buckle, including a tail clamp, a frame, a buckling pin, first connectors, and a second connector. Both the frame and the buckling pin are connected with the tail clamp and rotate relative to the tail clamp, and a first end of the tail clamp is configured to connect with a belt body. The first connectors are configured to connect the tail clamp with the frame, the second connector is configured to connect the tail clamp with the buckling pin. A fixing base is disposed on a second end of the tail clamp, and the fixing base includes a left part fixing base and a right part fixing base. The left part fixing base and the right part fixing base are symmetrically disposed, a gap is formed between the left part fixing base and the right part fixing base.

9 Claims, 6 Drawing Sheets

DOUBLE-SIDED USABLE BELT BUCKLE

TECHNICAL FIELD

The present disclosure relates to a technical field of belt accessories, in particulars to a double-sided usable belt buckle.

BACKGROUND

Nowadays, with prosperity of industry and prosperity of people's livelihood, clothes people wear represent an overall image and spiritual symbol of individuals. While belts are important accessories for clothing, which can be used for expressing beauty and can also be used for decorating. With the improvement of people's pursuit of the beauty, the clothing accessories are more and more diversified. Therefore, single-sided belts can not meet needs of people, double-sided belts come into being.

In the prior art of a technical field of belts, there is an urgent need of a belt buckle, the belt buckle is required to be stable, quickly installed and quickly turned over, so that both sides of the belt are usable.

SUMMARY

An object of the present disclosure is to provide a double-sided usable belt buckle which is stable, quickly installed and quickly turned over.

In order to achieve above object, the present disclosure provides the double-sided usable belt buckle, including a tail clamp, a frame, a buckling pin, first connectors, and a second connector. Both the frame and the buckling pin are connected with the tail clamp and rotate relative to the tail clamp, and a first end of the tail clamp is configured to connect with a belt body. The first connectors are configured to connect the tail clamp with the frame, the second connector is configured to connect the tail clamp with the buckling pin. A fixing base is disposed on a second end of the tail clamp, and the fixing base includes a left part fixing base and a right part fixing base. The left part fixing base and the right part fixing base are symmetrically disposed, a gap is formed between the left part fixing base and the right part fixing base. An opening is disposed on one side edge of the frame. The left part fixing base and the right part fixing base are rotationally connected with the frame respectively on two opposite sides of the opening of the frame through the first connectors. The gap formed between the left part fixing base and the right part fixing base is rotationally connected with the buckling pin through the second connector.

Furthermore, a left positioning hole and a right positioning hole are respectively disposed on the two opposite sides of the opening of the frame. A left fixing groove corresponding to the left positioning hole is disposed on the left part fixing base, and a right fixing groove corresponding to the right positioning hole is disposed on the right part fixing base. The first connectors include springs and pin shafts. The springs are respectively disposed inside the left fixing groove and the right fixing groove, and the pin shafts are configured to connect the left fixing groove with the left positioning hole and connect the right fixing groove with the right positioning hole.

Furthermore, flanges are formed on one end of the pin shafts, the flanges are embedded inside the springs. A diameter of the flanges is smaller than a diameter of an inner ring of the springs.

Furthermore, an axe of the left positioning hole, an axe of the right positioning hole, an axe of the left fixing groove, and an axe of the right fixing groove are on a same straight line.

Furthermore, the second connector includes a rotating shaft, two ends of the rotating shaft are respectively connected with the left part fixing base and the right part fixing base. A tail end of the buckling pin is rotationally connected with the rotating shaft, and a head end of the buckling pin abuts against the frame.

Furthermore, the rotating shaft, the left part fixing base and the right part fixing base are integrally formed.

Furthermore, the double-sided usable belt further includes a rotating mechanism, the rotating mechanism disposed between the fixing base and the tail clamp.

Furthermore, the rotating mechanism includes a fixing pin and a pressing spring sleeved on the fixing pin. A clamping head is disposed on one end of the fixing pin, and a limiting block is disposed on another end of the fixing pin. The pressing spring is disposed between the clamping head and the limiting block. A rotating shaft and a curved flange are disposed on a second end of the tail clamp. A connecting through hole is disposed on a center of the rotating shaft, and the connecting through hole is configured to install the fixing pin. A belt accommodating slot is disposed on a first end of the tail clamp, the connecting through hole is communicated with the belt accommodating slot. One end of the pressing spring is connected with a bottom of the belt accommodating slot, and another end of the pressing spring is connected with the limiting block. A rectangular groove, a counter bored hole, and a fixing pin penetrating hole are disposed on the fixing base. The counter bored hole is matched with the rotating shaft, and the fixing pin penetrating hole is communicated with the rectangular groove. A clamping slot is disposed on a position where the rectangular groove and the fixing pin penetrating hole are connected, and the clamping slot is matched with the clamping head. The fixing pin is inserted into the connecting through hole and the fixing pin penetrating hole.

Furthermore, the present disclosure further provides a belt, comprising the belt body and the double-sided usable belt buckle, and the the double-sided usable belt buckle is connected with the belt body.

According to above description of the present disclosure, compared with the prior art, the present disclosure provides the double-sided usable belt buckle and the belt, including the tail clamp, the frame, the buckling pin, the first connectors, and the second connector. Both the frame and the buckling pin are connected with the tail clamp and rotate relative to the tail clamp, and the first end of the tail clamp is configured to connect with the belt body. The first connectors are configured to connect the tail clamp with the frame, the second connector is configured to connect the tail clamp with the buckling pin. The fixing base is disposed on the second end of the tail clamp, and the fixing base includes the left part fixing base and the right part fixing base. The left part fixing base and the right part fixing base are symmetrically disposed, the gap is formed between the left part fixing base and the right part fixing base. The opening is disposed on one side edge of the frame. The left part fixing base and the right part fixing base are rotationally connected with the frame respectively on two opposite sides of the opening of the frame through the first connectors. The gap formed between the left part fixing base and the right part fixing base is rotationally connected with the buckling pin through the second connector. The double-sided usable belt buckle rotationally connects the tail clamp with the frame through first connectors, which can quickly install the tail clamp and the frame and make a structure of the double-sided usable belt buckle stable and compact, so that the tail clamp is not easily detached from the frame. The double-sided usable belt buckle further includes the rotating mechanism, which can quickly turn over the belt and make double sides of the belt usable.

DETAILED DESCRIPTION

Figure 1:
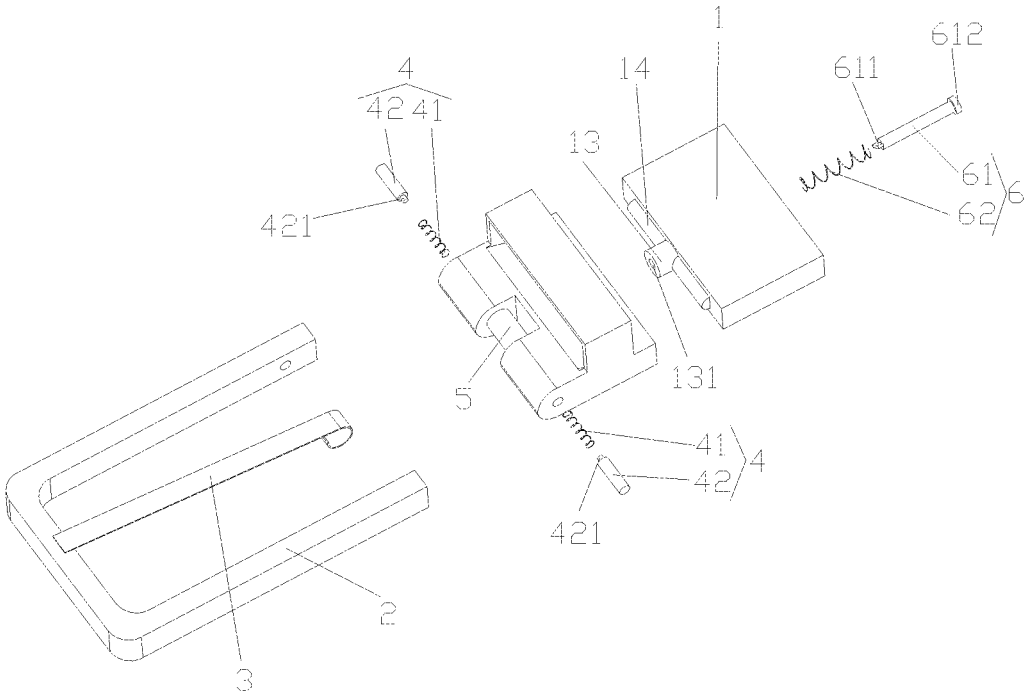
FIG. 1 is an exploded schematic diagram of a double-sided usable belt buckle according to the present disclosure.
Figure 2:
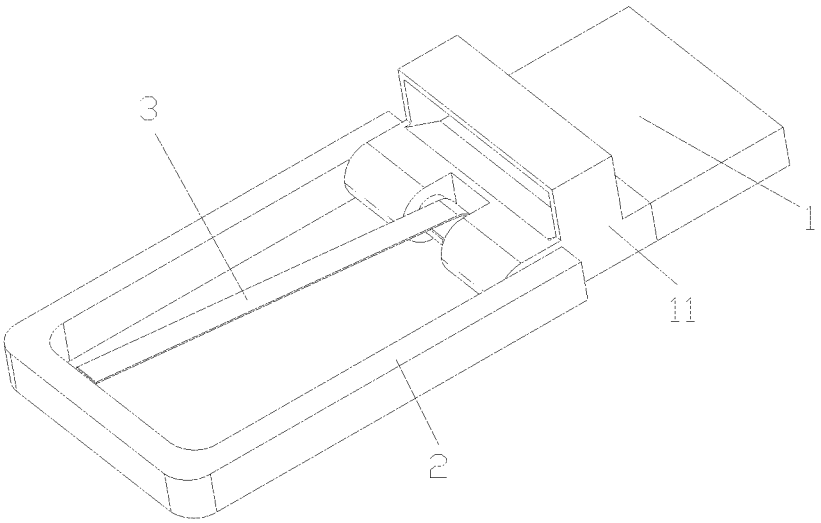
FIG. 2 is an overall schematic diagram of a double-sided usable belt buckle according to the present disclosure.
Figure 3:
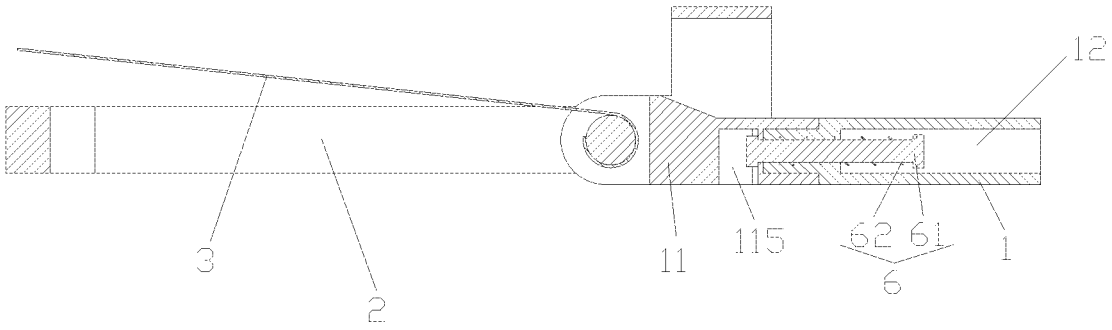
FIG. 3 is a cross sectional schematic diagram of a double-sided usable belt buckle according to the present disclosure.
Figure 4:
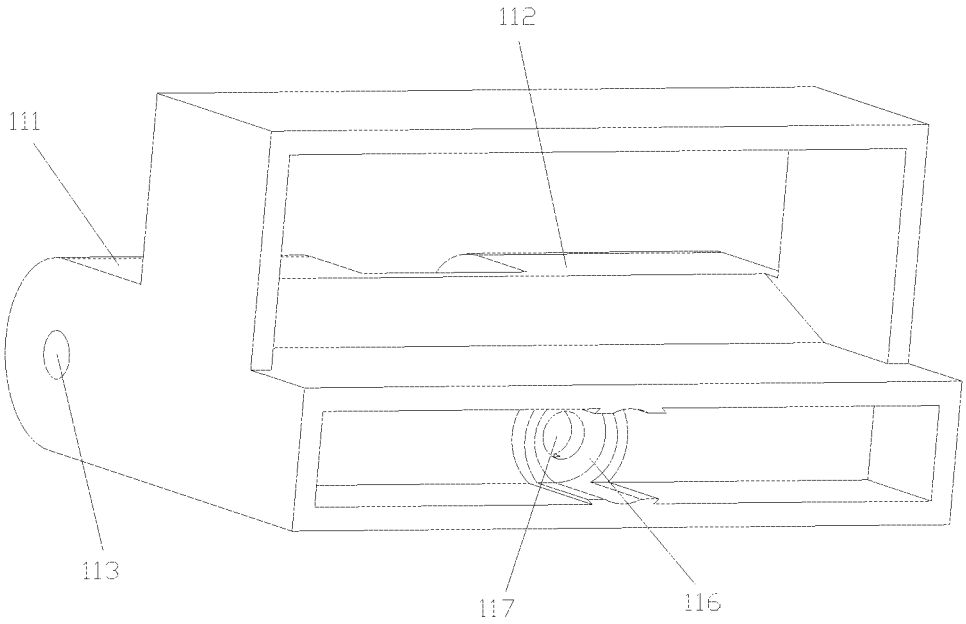
FIG. 4 is a schematic diagram of a fixing base of a double-sided usable belt buckle according to the present disclosure.
Figure 5:
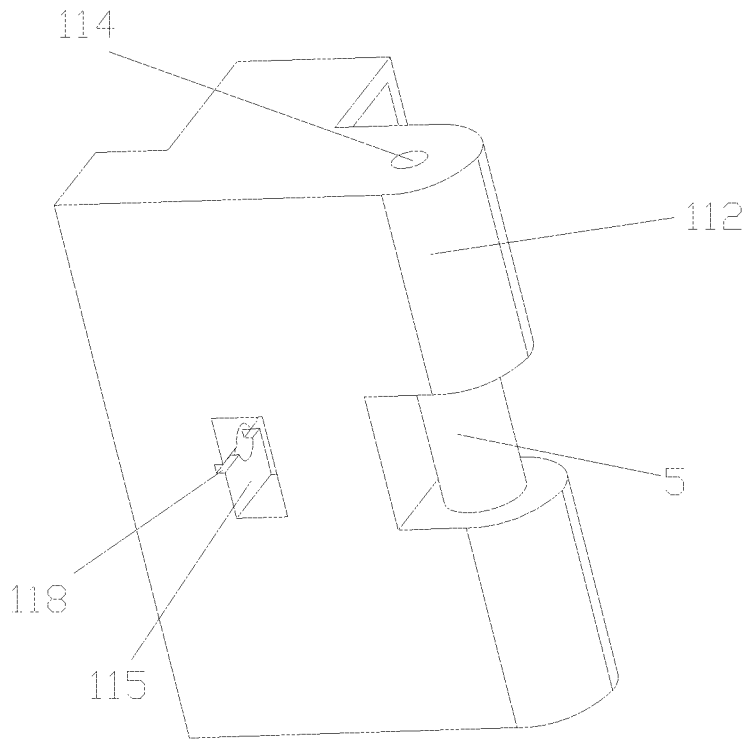
FIG. 5 is a schematic diagram of a rectangular groove of a double-sided usable belt buckle according to the present disclosure.
Figure 6:
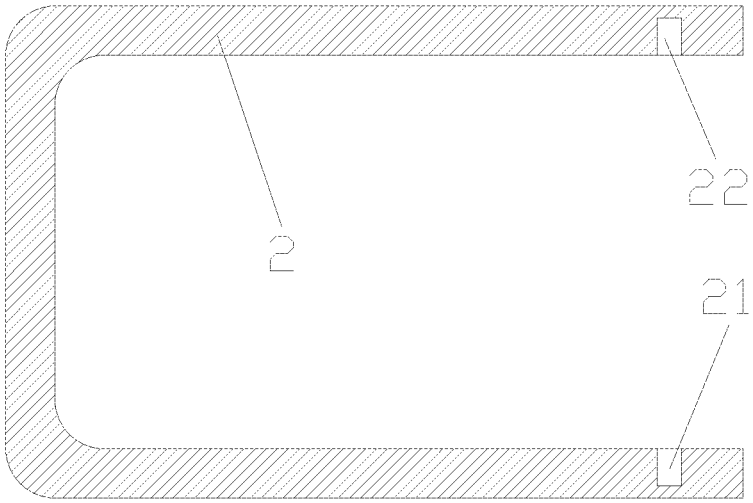
FIG. 6 is a cross sectional schematic diagram of a frame of a double-sided usable belt buckle according to the present disclosure.

The technical solution in the present disclosure is clearly and completely described below in connection with accompanying drawings of embodiments of the present disclosure. Obviously, the described embodiments are merely parts of the present disclosure and not all embodiments. Based on the embodiments of the present disclosure, those of ordinary skill in the art who obtain other all embodiments without making any inventive faculty, fall within the scope of the present invention.

It is to be noted that terms "includes", "including", as well as any variations thereof, are intended to cover a non-exclusive inclusion. For example, a process, method, system, product, or apparatus which includes a listed steps or units should be not limited by the listed steps or units, but may include other steps or units not expressly listed or inherent to such process, method, article, or apparatus.

As shown in FIG. the present disclosure provides a double-sided usable belt buckle, including a tail clamp 1, a frame 2, a buckling pin 3, first connectors 4, a second connector 5, and a rotating mechanism 6. Both the frame 2 and the buckling pin 3 are connected with the tail clamp 1 and rotate relative to the tail clamp 1, and a first end of the tail clamp 1 is configured to connect with a belt body. The first connectors 4 are configured to connect the tail clamp 1 with the frame 2, the second connector 5 is configured to connect the tail clamp 1 with the buckling pin 3. A fixing base 11 is disposed on a second end of the tail clamp 1, and the fixing base 11 includes a left part fixing base 111 and a right part fixing base 112. The left part fixing base 111 and the right part fixing base 112 are symmetrically disposed, a gap is formed between the left part fixing base 111 and the right part fixing base 112. An opening is disposed on one side edge of the frame 2. The left part fixing base 111 and the right part fixing base 112 are rotationally connected with the frame 2 respectively on two opposite sides of the opening of the frame 2 through the first connectors 4. The gap formed between the left part fixing base 111 and the right part fixing base 112 is rotationally connected with the buckling pin 3 through the second connector 5.

A left positioning hole 21 and a right positioning hole 22 are respectively disposed on the two opposite sides of the opening of the frame 2. A left fixing groove 113 corresponding to the left positioning hole is disposed on the left part fixing base 111, and a right fixing groove 114 corresponding to the right positioning hole 22 is disposed on the right part fixing base 112. The first connectors 4 include springs 41 and pin shafts 42. The springs 41 are respectively disposed inside the left fixing groove 113 and the right fixing groove 114, and the pin shafts 42 are configured to connect the left fixing groove 113 with the left positioning hole 21 and connect the right fixing groove 114 with the right positioning hole 22. An axe of the left positioning hole 21, an axe of the right positioning hole 22, an axe of the left fixing groove 113, and an axe of the right fixing groove 114 are on a same straight line. Flanges 421 are formed on one end of the pin shafts 42, the flanges 421 are embedded inside the springs 41. A diameter of the flanges 421 is smaller than a diameter of an inner ring of the springs 41. The flanges 421 are inserted into the inner ring the springs 41.

The second connector 5 includes a rotating shaft, two ends of the rotating shaft are respectively connected with the left part fixing base 111 and the right part fixing base 112. A tail end of the buckling pin 3 is rotationally connected with the rotating shaft, and a head end of the buckling pin 3 abuts against the frame 2. The rotating shaft, the left part fixing base 111 and the right part fixing base 112 are integrally formed. The tail end of the buckling pin 3 rotates around the rotating shaft, and then rotationally connects with the rotating shaft.

The double-sided usable belt further provides the rotating mechanism 6, the rotating mechanism 6 is disposed between the fixing base 11 and the tail clamp 1. The rotating mechanism 6 includes a fixing pin 61 and a pressing spring 62 sleeved on the fixing pin 61. A clamping head 611 is disposed on one end of the fixing pin 61, and a limiting block 612 is disposed on another end of the fixing pin 61. The pressing spring 62 is disposed between the clamping head 611 and the limiting block 612. A rotating shaft 13 and a curved flange 14 are disposed on a second end of the tail clamp 1. A connecting through hole 131 is disposed on a center of the rotating shaft 13, and the connecting through hole 131 is configured to install the fixing pin 61. A belt accommodating slot 12 is disposed on a first end of the tail clamp 1, the connecting through hole 131 is communicated with the belt accommodating slot 12. One end of the pressing spring 62 is connected with a bottom of the belt accommodating slot 12, and another end of the pressing spring 62 is connected with the limiting block 612, A rectangular groove 115 a counter bored hole 116, and a fixing pin penetrating hole 117 are disposed on the fixing base 11. The counter bored hole 116 is matched with the rotating shaft 13, and the fixing pin penetrating hole 117 is communicated with the rectangular groove 115. A clamping slot 118 is disposed on a position where the rectangular groove 115 and the fixing pin penetrating hole 117 are connected, and the clamping slot 118 is matched with the clamping head 611. The fixing pin 61 is inserted into the connecting through hole 131 and the fixing pin penetrating hole 117.

The present disclosure further provides a belt, the belt includes the belt body and the double-sided usable belt buckle, the double-sided usable belt buckle is connected with the belt body.

The working principle of the present disclosure is as follows:

The fixing base 11 is disposed on the second end of the tail clamp 1, and the fixing base 11 includes a left part fixing base 111 and a right part fixing base 112. The left part fixing base 111 and the right part fixing base 112 are symmetrically disposed, a gap is formed between the left part fixing base 111 and the right part fixing base 112. The rotating shaft is disposed inside the gap, the two ends of the rotating shaft are respectively connected with the left part fixing base 111 and the right part fixing base 112. The tail end of the buckling pin 3 is rotationally connected with the rotating shaft, and the head end of the buckling pin 3 abuts against the frame 2. The buckling pin 3 rotates around the rotating shaft. The opening is disposed on one side edge of the frame 2. The left positioning hole 21 and the right positioning hole 22 are respectively disposed on the two opposite sides of the opening of the frame 2. The left fixing groove 113 corresponding to the left positioning hole is disposed on the left part fixing base 111, and the right fixing groove 114 corresponding to the right positioning hole 22 is disposed on the right part fixing base 112. The springs 41 and the pin shafts 42 are disposed inside the fixing grooves, and the pin shafts 42 are configured to connect the left fixing groove 113 with the left positioning hole 21 and connect the right fixing groove 114 with the right positioning hole 22. The flanges 421 are formed on one end where the pin shafts 42 connects with the springs 41, the flanges 421 are embedded inside the springs 41. A diameter of the flanges 421 is smaller than a diameter of an inner ring of the springs 41. The flanges 421 are inserted into the inner ring the springs 41. During installation, the pin shafts 42 are pressed to retract into the fixing grooves and moved to the positioning holes, then the pressed pin shafts 42 should be released to clamp into the positioning holes, and quick installation is achieved. Meanwhile, the rotating mechanism 6 is disposed between the fixing base and the tail clamp 1, when the belt is to be turned over, the tail clamp 1 is rotated around the fixing pin 61. The curved flange 14 is disposed on the tail clamp 1, which is convenient for user to rotate.

While the foregoing is a description of several embodiments of the present disclosure, concepts of the present disclosure are not limited thereto. It is intended that the present disclosure not be limited to the particular embodiment disclosed, but on the contrary, the intention is to cover all such modifications as fall within the scope of the present disclosure.

What is claimed is:

1. A double-sided usable belt buckle, comprising a tail clamp (1), a frame (2), a buckling pin (3), first connectors (4), and a second connector (5); wherein both the frame (2) and the buckling pin (3) are connected with the tail clamp (1) and rotate relative to the tail clamp (1), and a first end of the tail clamp (1) is configured to connect with a belt body; the first connectors (4) are configured to connect the tail clamp (1) with the frame (2), the second connector (5) is configured to connect the tail clamp (1) with the buckling pin (3); a fixing base (11) is disposed on a second end of the tail clamp (1), and the fixing base (11) comprises a left part fixing base (111) and a right part fixing base (112); the left part fixing base (111) and the right part fixing base (112) are symmetrically disposed, a gap is formed between the left part fixing base (111) and the right part fixing base (112); an opening is disposed on one side edge of the frame (2); the left part fixing base (111) and the right part fixing base (112) are rotationally connected with the frame (2) respectively on two opposite sides of the opening of the frame (2) through the first connectors (4); the gap formed between the left part fixing base (111) and the right part fixing base (112) is rotationally connected with the buckling pin (3) through the second connector (5); a left positioning hole (21) and a right positioning hole (22) are respectively disposed on the two opposite sides of the opening of the frame (2); a left fixing groove (113) corresponding to the left positioning hole is disposed on the left part fixing base (111), and a right fixing groove (114) corresponding to the right positioning hole (22) is disposed on the right part fixing base (112); the first connectors (4) comprise springs (41) and pin shafts (42); the springs (41) are respectively disposed inside the left fixing groove (113) and the right fixing groove (114), and the pin shafts (42) are configured to connect the left fixing groove (113) with the left positioning hole (21) and connect the right fixing groove (114) with the right positioning hole (22).

2. The double-sided usable belt buckle according to claim 1, wherein flanges (421) are formed on one end of the pin shafts (42), the flanges (421) are embedded inside the springs (41); a diameter of the flanges (421) is smaller than a diameter of an inner ring of the springs (41).

3. The double-sided usable belt buckle according to claim 1, wherein an axe of the left positioning hole (21), an axe of the right positioning hole (22), an axe of the left fixing groove (113), and an axe of the right fixing groove (114) are on a same straight line.

4. The double-sided usable belt buckle according to claim 1, wherein the second connector (5) comprises a rotating shaft, two ends of the rotating shaft are respectively connected with the left part fixing base (111) and the right part fixing base (112); a tail end of the buckling pin (3) is rotationally connected with the rotating shaft, and a head end of the buckling pin (3) abuts against the frame (2).

5. The double-sided usable belt buckle according to claim 4, wherein the rotating shaft, the left part fixing base (111) and the right part fixing base (112) are integrally formed.

6. The double-sided usable belt buckle according to claim 4, wherein the tail end of the buckling pin (3) rotates around the rotating shaft, and then rotationally connects with the rotating shaft.

7. The double-sided usable belt buckle according to claim 1, wherein the double-sided usable belt further comprises a rotating mechanism (6), the rotating mechanism (6) is disposed between the fixing base (11) and the tail clamp (1).

8. The double-sided usable belt buckle according to claim 7, wherein the rotating mechanism (6) comprises a fixing pin (61) and a pressing spring (62) sleeved on the fixing pin (61); a clamping head (611) is disposed on one end of the fixing pin (61), and a limiting block (612) is disposed on another end of the fixing pin (61); the pressing spring (62) is disposed between the clamping head (611) and the limiting block (612); a rotating shaft (13) and a curved flange (14) are disposed on a second end of the tail clamp (1); a connecting through hole (131) is disposed on a center of the rotating shaft (13), and the connecting through hole (131) is configured to install the fixing pin (61); a belt accommodating slot (12) is disposed on a first end of the tail clamp (1), the connecting through hole (131) is communicated with the belt accommodating slot (12); one end of the pressing spring (62) is connected with a bottom of the belt accommodating slot (12), and another end of the pressing spring (62) is connected with the limiting block (612); a rectangular groove (115), a counter bored hole (116), and a fixing pin penetrating hole (117) are disposed on the fixing base (11); the counter bored hole (116) is matched with the rotating shaft (13), and the fixing pin penetrating hole (117) is communicated with the rectangular groove (115); a clamping slot (118) is disposed on a position where the rectangular groove (115) and the fixing pin penetrating hole (117) are connected, and the clamping slot (118) is matched with the clamping head (611); the fixing pin (61) is inserted into the connecting through hole (131) and the fixing pin penetrating hole (117).

9. A belt according to claim 1, comprising the belt body and the double-sided usable belt buckle; wherein the double-sided usable belt buckle is connected with the belt body.

* * * * *